United States Patent [19]

Verley

[11] 4,329,550

[45] May 11, 1982

[54] DELAYED ACTION LIQUID LEVEL SENSING APPARATUS

[75] Inventor: Donald Verley, Valencia, Calif.

[73] Assignee: McCann's Engineering & Manufacturing Company, Los Angeles, Calif.

[21] Appl. No.: 149,265

[22] Filed: May 12, 1980

[51] Int. Cl.[3] ..... H01H 35/18

[52] U.S. Cl. ..... 200/84 C; 361/399; 340/624; 335/207

[58] Field of Search ..... 361/380, 331, 395, 399; 73/308, 313, 319; 340/623, 624; 200/61.2, 84 R, 84 C; 307/118; 335/205, 207, 153

[56] References Cited

U.S. PATENT DOCUMENTS

| | | | |
|---|---|---|---|
| 3,283,056 | 11/1966 | Cookerly et al. | 84/1.01 |
| 3,408,053 | 10/1968 | Vantroba | 200/84 C |
| 3,745,225 | 7/1973 | Hall | 84/1.03 |
| 3,746,773 | 7/1973 | Uetrecht | 84/1.01 |
| 3,823,246 | 7/1974 | Hebeisen et al. | 84/1.17 |
| 3,929,051 | 12/1975 | Moore | 84/1.17 |
| 3,990,339 | 11/1976 | Robinson et al. | 84/1.17 |
| 4,064,755 | 12/1977 | Bongort | 200/84 C |
| 4,112,802 | 9/1978 | Robinson et al. | 84/1.01 |
| 4,165,935 | 8/1979 | Bongort | 200/84 C |
| 4,213,110 | 7/1980 | Holce | 335/153 |
| 4,227,236 | 10/1980 | Kubler | 200/84 C |

*Primary Examiner*—Gerald P. Tolin
*Attorney, Agent, or Firm*—Lyon & Lyon

[57] ABSTRACT

A low liquid level float control apparatus particularly adapted for use in vessels or tanks containing a fluid of the type utilized in liquid vending machines is disclosed. An electronic control unit has a probe section extending downwardly therefrom containing a reed switch, which is activated by the passage of an annular magnet vertically along the probe section. A second magnet is secured about the lower most portion of the probe section and is adjustable along the probe section thereby increasing the switch delay time, thus reducing the possibility of intermittent on-off operation of associated pump elements.

7 Claims, 3 Drawing Figures

DELAYED ACTION LIQUID LEVEL SENSING APPARATUS

BACKGROUND OF THE INVENTION

This invention relates to switch devices having liquid level control capability and more particularly to those which are used to control the level of carbonated liquid contained in a vessel or storage tank associated with ordinary liquid vending machines.

Previously, vending machines of the aforementioned type have been required to contain vessels for storage of the carbonated liquid in a manner which when empty would necessitate the replacement of the vessel. It became particularly desirable to have a vessel or storage tank of a replenishable nature thereby obviating the necessity of replacing the vessels when empty. Concurrent with this desired development, it was necessary to have a sensing device adapted to determine the liquid level of the carbonated fluid or the like located within the replenishable tank. Probe devices were developed in which an annular magnet located upon a float element traversed vertically along a probe thereby activating or deactivating a reed switch of the conventional type.

Similarly, it became desirable to have a float control device able to maintain an extended fluid inlet cycle due to the dilaterious effect upon pump motors caused by rapid on-off operation, occasioned by small changes in the liquid level of the tank and associated traversal of the annular magnet. This has previously been accomplished, as in the U.S. Pat. No. 3,408,053, by an internally disposed magnetic sleeve element which caused the latch type components of the reed switch to maintain a juxtaposed relationship longer than would occur under normal activation by the position of an annular ceramic magnet located on the float element.

SUMMARY OF THE INVENTION

The present invention is directed to a low level fluid sensing and reed switch activation device with substantially different delay control features. The sensing device comprises a buoyant element upon which an annular magnetic component is integrally associated therewith, the buoyant element being capable of traversing in a vertical plane along a probe-like section suspended within a fluid medium. The buoyant element is capable of being suspended in a uppermost position by a fluid within a vessel against the force of gravity and is capable of traversing to a lowermost position upon the probe section in the absence of the fluid.

The traversal of the buoyant element containing the annular magnetic element opens or closes a reed switch, which either activates or deactivates an electrical circuit, which in turn energizes a pump device for replenishing the fluid in the vessel when near empty. The reed switch is located within the internal portions of the probe section. The probe section is adapted to be suspended from or secured to a control unit secured to the top wall of a fluid containing vessel having various liquids of the aforementioned type stored therein.

The placement of a second magnet at the lowermost portion of the probe section results in a residual magnetic field parallel with the probe section thereby causing the reed switch latch components to remain in a closed position for a longer period of time after the annular magnet carried upon the buoyant element has risen along the probe section to a position where it no longer has an actuable influence upon the reed switch latch components. Under normal circumstances the reed switch latch components would immediately open when not under influence of the magnet, thus terminating the operation of the replenishing pump. By adjusting the position of the second magnet, using a washer and nut arrangement, it is possible to vary, in accordance with the position of the buoyant element upon the vertically oriented probe section, the moment at which the reed switch latch components will open. By imparting a residual magnetic force upon the reed switch latch components, the dilaterious effect of continuous on-off operation of the motor operating the pump replenishing the tank or vessel, wherein the chemically active fluid is contained, is dramatically reduced.

It is accordingly a principal object of the present invention to provide an improved liquid level float control and switch activating device which is adapted for use in vending machines or the like.

It is another object of the present invention to provide a float control device especially adapted for use in a liquid vending machine with a replenishable fluid supply.

It is another object of the present invention to provide a device which has the ability to selectively control the delay time of a switch which activates replenishing pump elements, without having to disassemble the device.

It is a further object of the present application to provide a device capable of being implanted within a vessel containing carbonated fluid and have the active components protected in a medium impervious to the chemically active fluid contained therein.

These and other features, aspects, and advantages of the present invention will become better understood with reference to the appended claims, the following description, and accompanying drawings wherein;

DESCRIPTION OF THE PREFERRED EMBODIMENT

Figure 1:
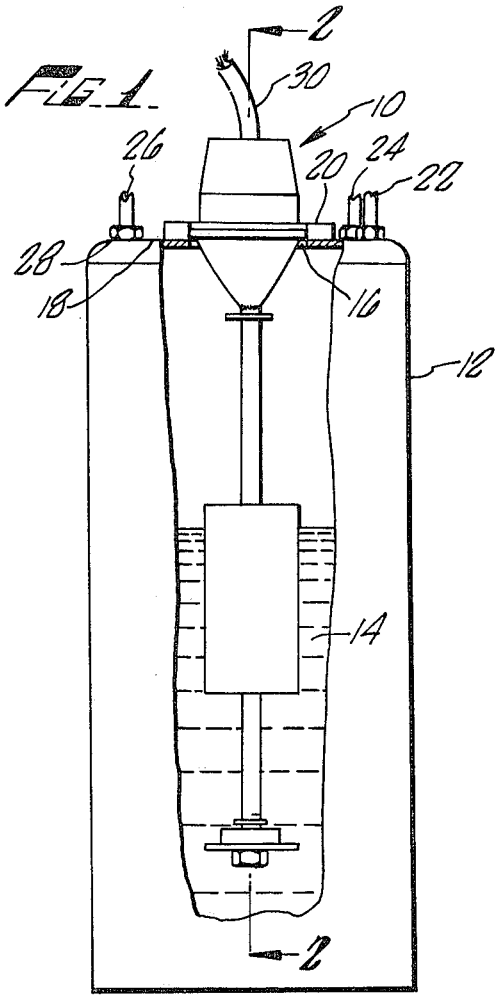
FIG. 1 is a broken away view of a tank structure illustrating the position of the probe float apparatus of the present invention when in use.
Figure 3:
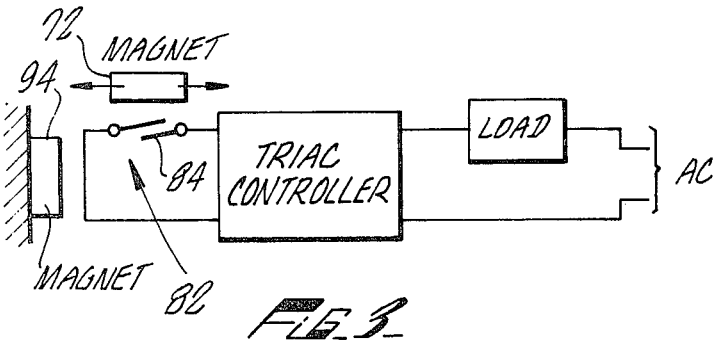
FIG. 3 is a block diagram of the electric circuitry incorporated within the present invention.

As shown in FIG. 1, the invention of the present application consists of a liquid level sensing apparatus 10, which is of a generally elongated shape and fits snugly within a replenishable tank 12 containing a body of carbonated fluid 14 or the like. The tank 12 has an orifice 16 adapted to receive the liquid level sensing apparatus 10, which is suspended from the top 18 of the tank 12. A hermetic sealing component 20 is provided between the tank 12 and the apparatus 10 to maintain the carbonation level of the fluid 14 contained within the tank 12.

If used for the purposes of holding carbonated fluid, the tank 12 also contains an inlet tube 22 for carbon oxide, an inlet tube 24 for water and an outlet tube 26 for the carbonated fluid. Lock nuts 28 provide for the easy removal of the tubes 22, 24, and 26 and further are adapted to provide a hermetic seal with the tank 12. A cord 30 protrudes from the top of the liquid level sensing apparatus 10 and is provided with a plug (not shown) for use with a motor (not shown) which activates pumping elements replenishing the fluid 14 within the tank 12. The invention of the present application may be utilized with electric motors or other fluid pump devices with the same degree of effectiveness. It should also be noted that although the present application is directed toward the use of the present invention with vessels containing carbonated fluids, as used in liquid vending machines, the probe float apparatus 10 may be used with other systems wherein it is desirable to maintain pre-set fluid levels and activate replenishing devices when the fluid levels drop below a certain minimum. In those instances removal of one of the inlet tubes 22, 24, 26 will facilitate utilization of the float apparatus 10 in a one-fluid system.

Figure 2:
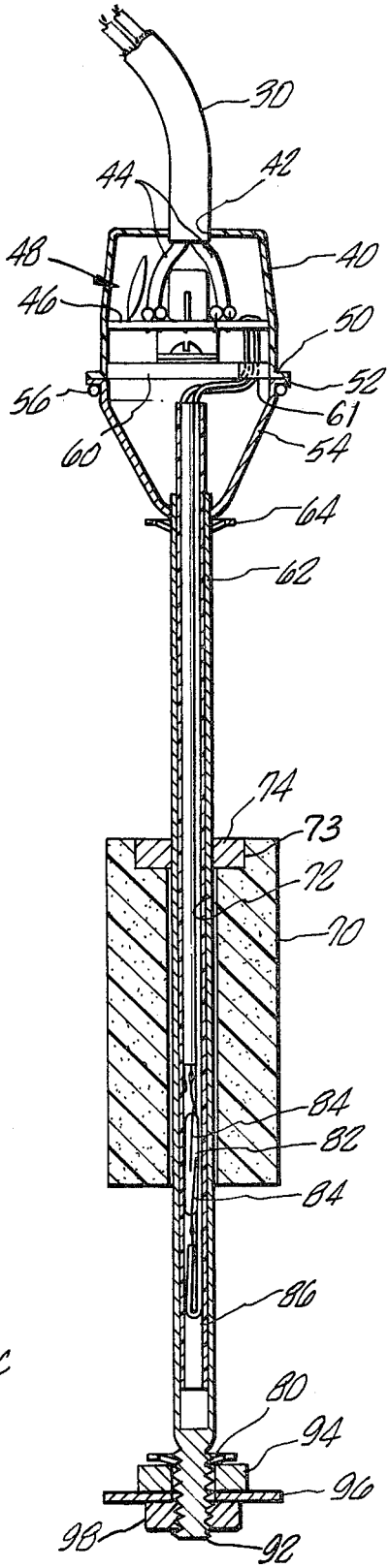
FIG. 2 is a cross-sectional of the probe float apparatus embodying the elements of the present invention.

As shown in FIG. 2, the invention of the present application in further detail is comprised of an open-ended substantially cylindrical shell 40 composed of an elastomer such as polyethylene or molded nylon, the shell 40 having generally flexible characteristics. In the upper area of the shell 40 there is provided an orifice 42 from which the cord 30 protrudes. The cord 30 has two leads 44 each of which are attached by conventional means to electronic circuitry provided within the cylindrical housing 40. These same leads terminate in a plug (not shown) at the distal end of the cord 30 for activation of the pumping elements. An integrated circuit card 46 provides attachment loci for the leads 44 by welding or other appropriate methods and acts a base for the attachment of other electrical components 48 which will be described in more detail later in the application. At the lowermost portion of the housing 40 a flange 50 is provided, which abuts against an opposing flange 52 of a downwardly projecting conical housing 54. The conical housing 54 is made up of a material substantially impervious to the chemically active body of fluid 14 found within the tank 12, as movement of the tank 12 may cause a splashing of the liquid over the housing 54. At the uppermost portion of the housing 54 and on the outside thereof is an o-ring 56 which is used to hermetically seal the liquid level sensing apparatus 10 to the top 18 of the tank 12. A base plate 60 fits snugly within the upper section of the housing 54 and has an aperture 61 for permitting the entry of electrical connections into the cylindrical shell 40 and for further acting as a internal seal to the possibility of any fluid 14 entering the cylindrical shell 40.

Projecting downwardly from the housing 54 is a sleeve 62 which is secured rigidly to the housing 54 by welding or other appropriate techniques of fastening such as crimping. The sleeve 62 is made of stainless steel in the preferred embodiment; however, it is apparent that other materials may be used in accordance with the type of fluid 14 to be stored in the tank 12. The sleeve 62 projects slightly into the housing 54 thus providing an additional attachment surface for these two components. At the uppermost portion of the sleeve 62 is a top restraining ring 64 which is slit to provide for its entry upon the sleeve 62, while restricting its downward movement on the sleeve 62 during use of the liquid level sensing apparatus 10. It should be noted that within the shell 40 and housing 54 there may be injected a medium, which by surrounding the internal components, will make those components impervious to any chemically active fluid 14 that may enter the shell 40 or housing 54.

A float element 70 is generally cylindrical in shape and is adapted to traverse vertically along the sleeve 62 due to the presence of a slot 72 running along the vertical length of the element 70 and substantially in the center thereof. The float element 70 may be either solid or have hollow portions depending upon the desired responsiveness of the float element 70 to liquid level changes within the tank 12. A magnetic element 74 is substantially annular in shape and is integral with the float element 70 at its uppermost section by being imbedded within a groove 73 in the element 70. Although shown integral with the float element 70 in its uppermost section, the magnetic element 74 may be disposed at various positions within the float 70 depending upon the desirability of having that element 74 being made impervious to any chemically active fluid 14 within the vessel 12. The magnetic element 74 because seated within the float 70 is caused to traverse vertically with the float 70 in the presence or absence of the fluid 14 in the tank 12. Although shown to be cylindrical, the float 70 may be constructed in various shapes without departing from the spirit or scope of the invention. Similarly, the float element 70 may be made of any material that is impervious to a chemically active fluid 14, and has a specific gravity less than the fluid 14, such as, styrofoam, neoprene or foam polyethylene.

At the lowermost portion of the sleeve 62, a bottom restraining ring 80 has a slot therein making the ring 80 easily slidably upon the sleeve 62 while restricting its downward movement off the sleeve 62. The ring 80 is vertically adjustable in conformity with desired fluid levels in the tank 12. Although shown as rings with slots therein, the restraining rings 64 and 80 may have various different shapes or constructions and yet perform the same function. Namely, the rings 64 and 80 may also be nuts adjustably positioned on threaded sections of the sleeve 62 or simply washers welded onto the sleeve 62.

At the lowermost portion of the sleeve 62, is a screw section 92 integral with the sleeve 62 and adapted to receive a second magnet 94 which is substantially annular in shape and entirely surrounds the screw section 92. A washer 96 and nut 98 suspend the magnet 94 along the screw section 82. The screw section 92 is of sufficient length that adjustments may be made of the vertical position of the magnet 94 with respect to the remaining components of the liquid level sensing apparatus 10.

Located within the sleeve 62 is a normally-open reed switch 82 which has latch type elements 84 movable in response to a magnetic field oriented parallel to the sleeve 62. The latch elements 84 move radially within the sleeve 62 toward each other thereby contacting, when under the influence of the magnetic element 74. The reed switch 82 is disposed within an electrically insulating material 86 which extends throughout the entire sleeve 62 and vertically to a position just short of the base 60. This material 86 keeps the chemically active fluid 14 from interfering with the reed switch 82 when in use. The reed switch 82 also has two leads, one extending from each at the latch elements 84, the leads passing through the base 60 and being soldered to the underside of circuit card 46. The leads are also entirely surrounded by the material 86 when in the sleeve 62.

As stated earlier, and as shown in FIG. 2, located within the housing 40 upon the integrated circuit 46 are a series of electrical components 48 which constitute the activation circuitry for an electric motor or other pumping devices (not shown). Briefly, the electric circuitry is substantially the same as shown in U.S. pat. No. 3,408,053, which is incorporated herein by reference. The electrical components 48 are surrounded by a potting material making the components impervious to the splashing or turbulence of a fluid 14 within the tank 12. The potting material also acts as a heat sink material discharging any heat in the integrated circuit 46 through the walls of the housing 40.

In operation, when a sufficient quantity of carbonated fluid or the like is contained within the tank 12 the float 70 is moved to an upper position, said movement terminated by the restraining ring 64. At this point in time, the magnetic element 74 does not have an actuable influence upon the reed switch 82. After a certain amount of the carbonated fluid 14 is removed from the tank for use in a vending machine or the like, the float 70 will traverse vertically downward along the sleeve 62 to a position wherein the magnetic element 74 has an actuable influence upon the latch elements 84 of the reed switch 82 causing them to radially move toward each other. The lower restraining element 88 terminates the movement of the float 70 in a downward direction. At a point in time, the latch elements 84 will contact one another thereby energizing the electronic components 48 thus starting the pump (not shown) which then replenishes the fluid 14 within the tank 12, through inlet tube 24. The fluid 14 added by the pump will continue to rise along the sleeve 62 within the tank 12 until such time as the float element 70 traverses to a position wherein the magnetic element 74 no longer has an actuable influence upon the reed switch elements 84. At this point in time the reed switch elements 84 would normally open thus de-energizing the electric components 48 and turning off the pump motor.

Although the magnetic element 74 will pass to a position where it no longer has an actuable influence upon the latch elements 84 of the reed switch 82, the presence of a second magnet 94 which induces a magnetic field parallel to the sleeve 62, will cause the elements 84 to remain in a contact position for a longer period of time than under the actuable influence of the magnetic element 74. With the latch elements 84 contacting one another the magnetic force required to sutain the closed position can be substantially reduced prior to opening the reed switch 82. This is necessary because small fluctuations in the position of the float 70 with respect to the reed switch 82 would cause intermittent on-off operation of the motor driving the pump and thus potentially damage the motor. A position of the magnet 74 is finally reached wherein the magnetic field imparted by the magnet 94 is insufficient to sustain the contact of the elements 84 and the reed switch 82 opens shutting off the pump.

The magnet 94 is suspended by the washer 96 and nut 98 in a manner that its position with respect to the reed switch 82 may be varied in accordance with the contact time desired of the latch elements 84. The magnet 94 produces a magnetic field small enough not to continuously cause the latch elements 84 to contact, while nonetheless providing a field strong enough to make the float probe apparatus 10 substantially impervious to small changes in the fluid level 14 of the tank 12. By placing the magnet 94 at the lowermost portion of the sleeve 62, it is easily movable in a vertical direction, thus variations in the contact time period of the latch elements 84 may easily be made. Similarly, disassembly of the probe float apparatus 10 is not required to effect these modifications.

It is significant to note that none of the elements which may be damaged by the chemically active fluid 14 are located in a position wherein said fluid 14 will interact with them. In this regard magnetic elements should be made with a material, namely, ceramic or alnico, which are substantially impervious to the presence of a chemically active fluid. As a result of this configuration, the liquid level sensing apparatus 10 of the present application may be used for long periods of operation without repair.

Although the present invention has been described in considerable detail it should be noted that other versions are possible. For example, the second magnetic element 94 may be placed at various positions along the sleeve 62 other than the lowermost portion thereof, yet accomplish the same result. Therefore, the spirit and scope of the appended claims should not be limited to the restrictions of the preferred embodiment contained herein.

I claim:

1. In a liquid level float controlled switch apparatus having a housing within which electrical components are present in a fluid-tight medium, and a probe section integral with and suspended from said housing; the improvements comprising, in combination:

a float means disposed about said probe section for traversing said probe section in a vertical plane, a first magnet integral with said float means, a magnetically operated switch means located within said probe section and having oppositely facing magnetic elements adapted to contact one another in response to the presence of a magnetic field occasioned by the position of said first magnet relative to said magnetic elements, a second magnet disposed in a vertical plane and spaced apart on the same axis from said magnetic switch means, said second magnet slidably engaged with the exterior of said probe section.

2. The liquid level float controlled switch apparatus of claim 1, which includes, a means for adjusting the relative vertical position of said second magnet in relation to the magnetic switch means.

3. In a liquid level float controlled switch apparatus having a housing adapted to be secured to a tank structure, and having a probe section, which has top and bottom restraining elements, said probe section suspended from said housing into a fluid medium, the improvement comprising, in combination:

a float means for traversing vertically along said probe section from a first position at the bottom restraining element to a second position at the top restraining element, a first magnetic element integral with said float means, a magnetically actuated switch means disposed within said probe section for activating an electric circuit, said switch means having oppositely facing latch elements, a second magnetic element slidably engaged with the lower most external portion of said probe section, said second magnetic element vertically spaced a discreet distance from said said switch means on the same axis, whereby movement of said float means within a determined range causes said first magnetic element to move said latch elements into a contacting relationship, thus energizing said electric circuit, said contacting relationship being extended in time due to the presence of said second magnetic element.

4. The liquid level float controlled switch apparatus of claim 3, wherein said bottom restraining element is said second magnetic element.

5. The liquid level float controlled switch apparatus of claim 4, which includes means for adjusting the position of said second magnetic element vertically along said probe section.

6. In a liquid level float controlled switch apparatus, having a housing with a probe section integral therewith and suspended therefrom into a liquid medium and an electrical circuit disposed within said housing; the improvement comprising, in combination, an electrically nonconductive liner element enclosed within said probe section.

a magnetically actuated switch means disposed within said liner element and having two leads passing therefrom, said switch means having a pair of oppositely positioned magnetically moveable latch elements, said latch elements each having an electrically conductive material integral with only one of said leads, a float means adapted to traverse vertically along said probe section, a first magnetic element integral with said float means, a stop means secured to said probe section, said stop means adapted to restrain movement of said float means in a downward direction along said probe section, a second magnetic element for continuously imparting a residual magnetic force upon said latch elements, said second magnetic element being spaced a discreet verticle distance on the same axis from said latch elements, said second magnetic element slidably located on the exterior of said probe section, whereby movement of said float means along said probe section causes said magnetic latch elements to contact one another when said first magnetic element has an actuable influence on said latch elements, and to remain in contact for a longer period of time after said first magnetic element ceases to have an actuable influence on said latch elements due to the presence of said second magnetic element.

7. The apparatus of claim 6, which includes means for varying the position of said second magnetic element vertically along said probe section.

* * * * *